United States Patent [19]

Holmes

[11] 3,936,219

[45] Feb. 3, 1976

[54] FLEXIBLE TURBINE MISSILE SHIELD

[75] Inventor: Martin E. Holmes, Philadelphia, Pa.

[73] Assignee: Westinghouse Electric Corporation, Pittsburgh, Pa.

[22] Filed: June 10, 1974

[21] Appl. No.: 478,130

[52] U.S. Cl. ..... 415/121 G; 74/609; 176/DIG. 2; 415/9

[51] Int. Cl.[2] ..... F04D 29/70

[58] Field of Search ..... 415/9, 121 G; 74/609; 176/87, DIG. 2; 102/22; 248/25

[56] References Cited

UNITED STATES PATENTS

| | | | |
|---|---|---|---|
| 1,698,514 | 1/1929 | Schmidt | 415/9 |
| 3,203,180 | 8/1965 | Price | 415/9 |
| 3,602,602 | 8/1971 | Motta | 415/9 |
| 3,801,416 | 4/1974 | Gulbierz | 102/22 |
| 3,814,016 | 6/1974 | Leach et al. | 102/22 |

*Primary Examiner*—Henry F. Raduazo
*Attorney, Agent, or Firm*—George M. Medwick

[57] ABSTRACT

A flexible missile shield disposed about a turbine element. This shield is deflectable to dissipate and absorb kinetic energy associated with flying objects emanating from the turbine apparatus and able to maintain the flying objects within a predetermined volume surrounding the turbine.

16 Claims, 4 Drawing Figures

FLEXIBLE TURBINE MISSILE SHIELD

BACKGROUND OF THE INVENTION

1. Field of the Invention:

This invention refers to steam turbine apparatus and in particular, to a flexible missile shield surrounding the turbine apparatus.

2. Description of the Prior Art:

If a large turbine generator power plant were to undergo an unexpected malfunction, such as a sudden loss of associated electrical load, while the turbines within the plant are operating at running speed, an overspeed condition is likely to occur. If the condition is not checked, the turbine could possibly fling itself apart, creating a large number of flying objects each having associated therewith a high kinetic energy. The safety problems created by the large numbers of flying objects emanating from the turbine are increased if the turbine which is destroyed is part of a nuclear steam power plant. The danger increases due to the potential hazards presented if one of the flying objects were to impinge upon and rupture any of the vital facilities associated with the nuclear side of the power plant, such as the waste fuel disposal storage piles located in nuclear power stations.

Of course, the primary method of insuring against such potential hazards is to effectively plan for each contingency condition which could arise, and taking steps to prevent any situation which would cause the turbine to literally fly apart. Also, planning the arrangement of the power plant in such a way as to minimize the accessibility of the number of vital targets likely to be struck by the high energy flying objects is another method of reducing the possibility of harm caused by turbine fragments. However, other prophylactic measures in addition to those mentioned are desirable, both from the standpoint of the power generating utility, which must meet certain safety requirements before construction or use permits are issued thereto, and from the Nuclear Regulatory Agency, which sets the applicable standards to be met before it issues any construction or use permits.

One such solution is to design the turbine casing itself in such a manner as to prevent the escape of flying objects therefrom. However, the casing structure which results when the casing is relied upon as a missile barrier has characteristics that seriously compromise the important functions of the turbine casing. In order for the casing-rotor-blade system of the turbine to efficiently and reliably generate power, the casing has the primary function first to contain and to guide required flows of steam through and around the blade path with minimum pressure losses, and second, to do this with a casing geometry having minimized thermal distortion and offering maximum resistance to thermal cyclic cracking. These functional requirements generally dictate minimizing wall thickness to the extent that they are compatible with pressure containment requirements.

However, analytical studies have shown that missile containment requires casing thicknesses of 10 to 15 times those presently required to satisfy the power generation function. For example, this guideline would require that the walls of the typical low pressure turbine casing, presently on the order of 1 to 1½ inches thick, would increase to become within the range of 10 to 22 inches thick. Such increase thickness engenders much higher thermal stresses and distortions than occur in the present turbine casing construction, and in addition reduce casing life. Of course, other problems, such as manufacture and shipment of these more massive casings, plus stronger and more costly foundations also occur as a concomitant to reliance upon the casing as the primary missile barrier.

Another proposed solution is to dispose external to the turbine a thick, rigid, wall of steel or concrete enclosing the turbine apparatus to maintain flying objects within a predetermined volume about the apparatus. For a steel barrier, wall thickness on the order of 8 to 12 inches is necessary to provide an appropriate shield to maintain flying objects within a predetermined volume around the apparatus. One drawback with such a barrier design is the amount of weight that must be supported by the foundation and the support members keeping the barriers spaced away from the turbine. Another problem is the necessity of dismantling the barrier when periodic down-time inspection of the turbine are undertaken, with the attendant problems of handling such bulky and unwieldy missile barriers.

Although the prior art method of shielding has some disadvantages, it is evident that protection for sensitive components of the power plant must be provided to prevent any damage or potential hazards to personnel or property should a turbine apparatus be destroyed.

SUMMARY OF THE INVENTION

This invention discloses a flexible missile shield surrounding a turbine apparatus disposed on a foundation in a steam turbine power plant. The shield comprises a support framework having plate members attached thereto, the shield deflecting to absorb and dissipate kinetic energies of flying objects emanating from the turbine and maintain these objects within a predetermined volume about the turbine. The framework is fabricated of a woven steel cable mesh upon which are clamped a plurality of steel plates. The mesh framework is anchored to the foundation and the shield is supported away from the turbine with suitable support means. When the shield acts as a barrier to dissipate energy of flying objects, the compressive force normally exerted on the support means changes to a tension force exerted upon the anchor means.

An object of this invention is to provide a flexible shield for dissipating energy of flying objects and to maintain such flying objects in a predetermined volume about a turbine apparatus. It is a further object of this invention to provide a turbine missile shield having a relatively lightweight, strong, flexible, woven steel cable mesh framework and attached thereto a plurality of steel plate members, the shield deflecting to dissipate and absorb the kinetic energies associated with flying objects emanating from the turbine and to maintain these objects within a predetermined volume about the turbine.

BRIEF DESCRIPTION OF THE DRAWINGS

The invention will be more fully understood from the following detailed description of an illustrative embodiment taken in connection with the accompanying drawings, in which.

DESCRIPTION OF THE PREFERRED EMBODIMENT

Figure 1:
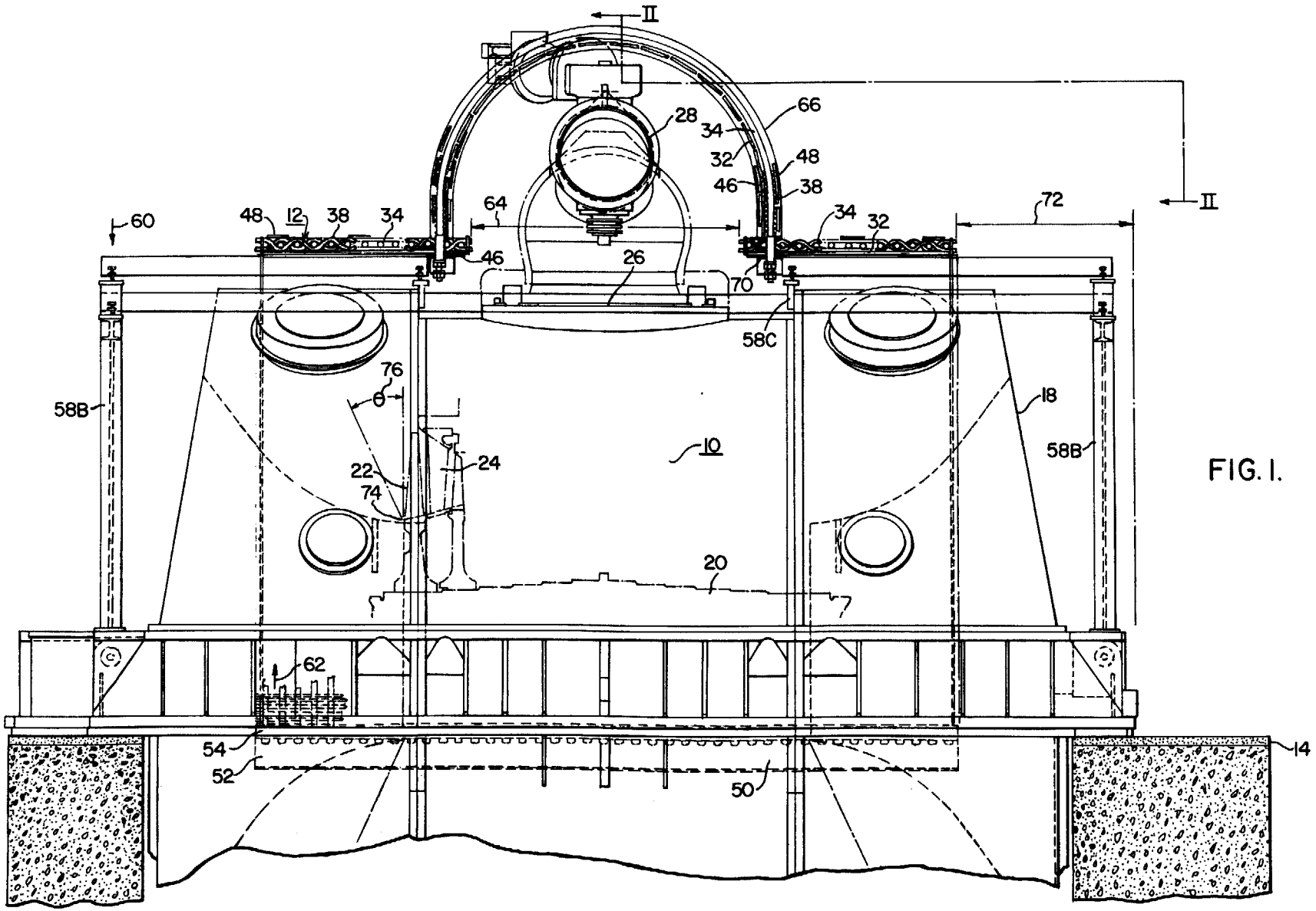
FIG. 1 is an elevational view of a steam turbine having disposed thereabout a missile shield embodying the teachings of this invention.

Throughout the following description, similar reference characters refer to similar elements in all figures of the drawings.

Figure 2:
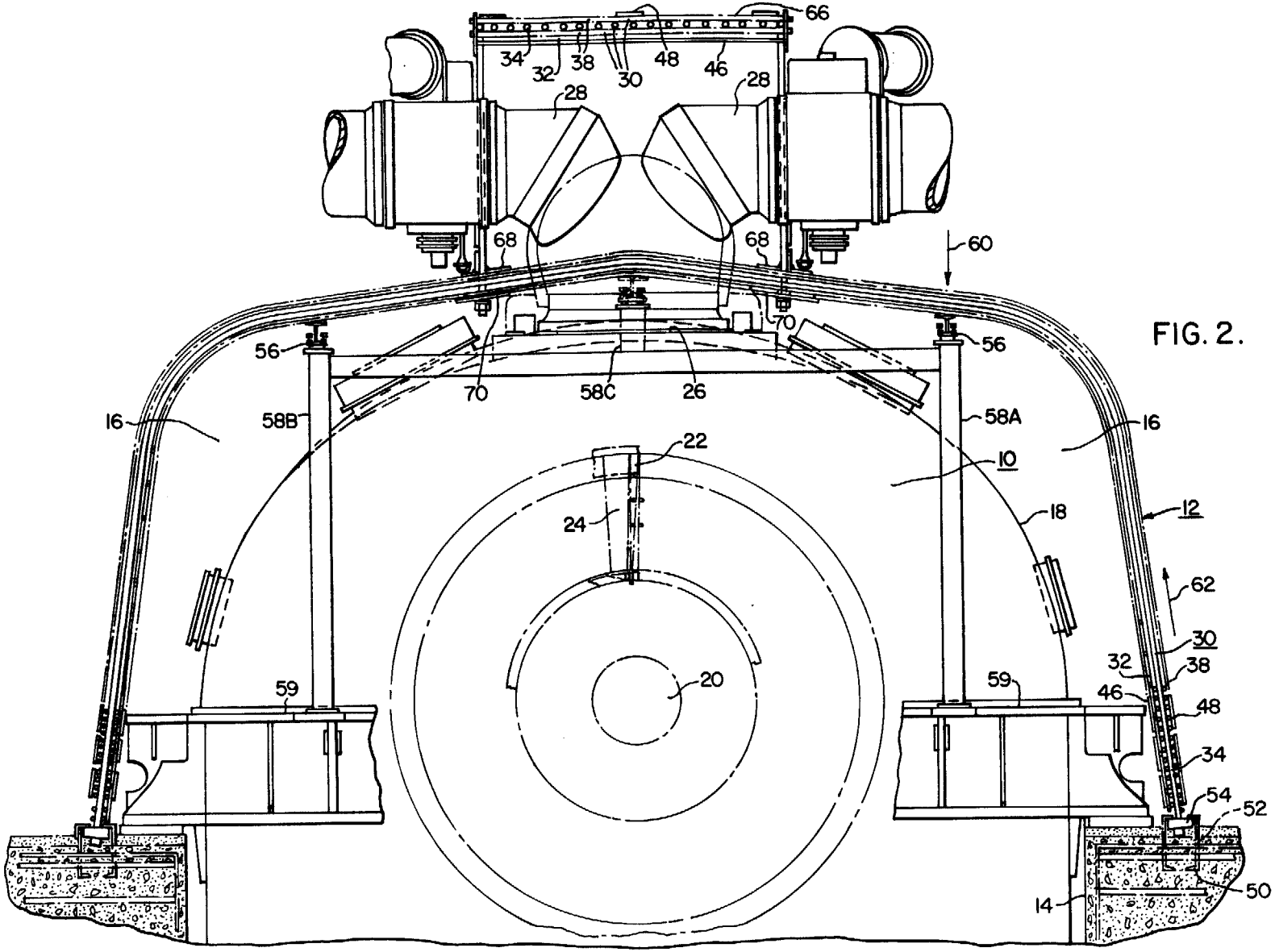
FIG. 2 is a transverse view taken along line II—II of FIG. 1.

Referring to FIGS. 1 and 2 an elevational and transverse view of a turbine element 10 of a nuclear steam turbine power plant having a flexible missile shield 12 disposed thereabout is shown. The turbine 10 itself is mounted upon a foundation 14, usually fabricated of steel reinforced concrete. The shield 12 encloses a predetermined volume 16 surrounding the turbine 10. Although the turbine 10 is part of a nuclear steam power plant, it is to be understood that the shield 12 can be disposed about any turbine element or any other device having rotating parts contained therein and from which flying objects having high kinetic energy may emanate. The possibility of flying objects striking vital elements in a nuclear steam turbine power plant is, however, more acute, and for this reason, the provision of a missile shield such as that embodying the teachings of this invention is especially attractive both to generating utility companies and to the Nuclear Regulatory Agency, which sets safety guide lines and requirements which must be met before construction or operating permits are issued.

The turbine 10 comprises an outer casing 18, usually fabricated of steel, encompassing and enclosing a rotatable shaft 20 having a plurality of arrays of rotating blades 22 mounted thereon. The rotating blades 22 interact with a motive fluid directed to impinge thereon by a plurality of arrays of stationary blades 24 to convert the energy carried by the motive fluid into rotating mechanical energy. A steam inlet 26, which permits entry of steam into the turbine 10 from conduits 28, is disposed in the casing 18. The conduits 28 may come from a steam generator or the exhaust of a higher pressure turbine. Once the steam is permitted to expand through the turbine 10, it exits to other lower pressure turbines or a condenser (not shown).

The casing 18 is usually, in a low pressure turbine element, 1 to 1½ inches thick and has as its primary function pressure containment of the motive steam utilized by the alternating arrays of blading within the casing 18. It has been suggested that the casing 18 be strengthened to provide an integral missile barrier therewith, but to do so would require approximately 10 to 15 times the steel currently used to fabricate the casing 18. In addition to cost, manufacturing, and shipping problems, large thermal distortions would occur with a casing having the postulated thickness. Also, the weight required to be supported by the foundation 14 would be prohibitive.

An alternative is to use a concrete or steel shield completely surrounding the turbine 10 to prevent flying objects from leaving a predetermined volume surrounding the turbine 10. In addition to the high cost, placing such weight upon the foundation is undesirable. Also, the difficulty of handling and dismantling the shield to permit access to the turbine for ordinary and necessary repairs and maintenance make this protective alternative unattractive.

Figure 3:
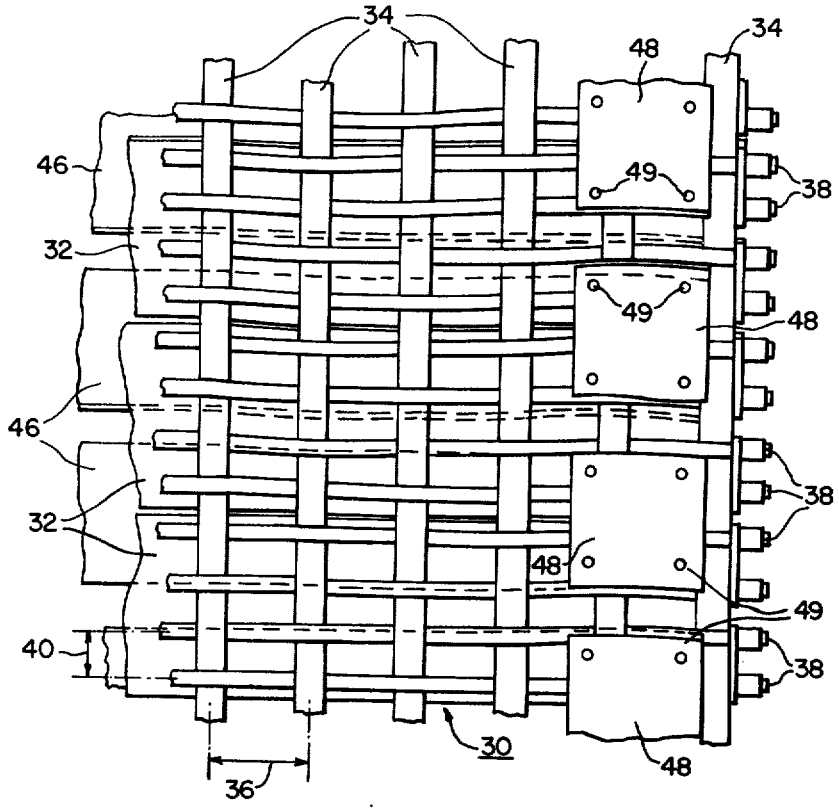
FIG. 3 is an enlarged view of a portion of the turbine missile shield.
Figure 4:
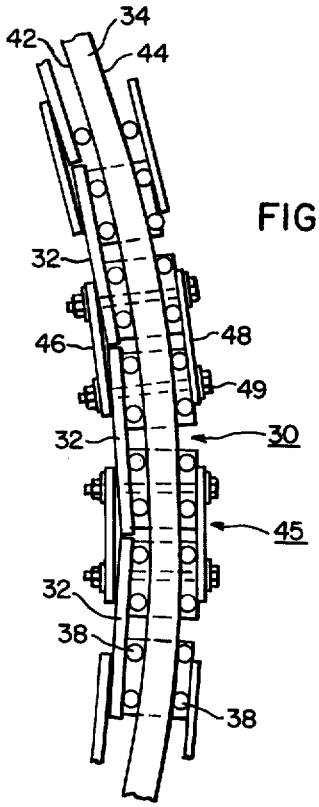
FIG. 4 is a view similar to FIG. 3 showing a portion of the turbine missile shield embodying the teachings of this invention.

This invention as shown in the drawings, discloses a flexible shield 12 about the turbine. The shield 12 has a support framework 30 to which is attached a plurality of heat treated hardened steel plate members 32. The frame 30 is fabricated of interwoven mesh of steel cables. A first plurality 34 of steel cable support members extends circumferentially about the turbine 10. The members 34, which comprise the "weft" of the mesh framework weave are disposed a predetermined axial distance 36 between each other. A second plurality 38 of steel cables, which comprise the "warp" of the weave, extend longitudinally and are interwoven with the first plurality 34. As seen in the figures, the strands of cables of the second plurality 38 are disposed predetermined circumferential distances 40 from each other and pass both on the radially inward side 42 and the radially outward side 44 of the first plurality 34 of steel cables. The interwoven plurality of steel cables forms an open mesh support framework 30 to which are attached the plurality of heat-treated hardened steel plate members 32. The plate members 32 are disposed on the radially inward side 42 of the framework 30 and each plate member 32 completely covers an opening in woven mesh framework 30. As thus seen in FIGS. 3 and 4, the plates 32 are clamped together, both longitudinally and radially, by suitable clamping means 45. The clamping means 45 comprise metal sheets 46 disposed on the radially inward side of the support framework 30 and metal sheets 48 disposed on the radially outward side of the framework 30. Bolts 49 extend between sheets 46 and 48 to secure them in position. As best seen in FIGS. 3 and 4, sheets 46 are disposed so as to overlap the gaps between adjacent steel plate members 32.

The shield 12 thus is a flexible, strong, relatively lightweight member which is able to deflect, dissipate, and absorb kinetic energies associated with flying objects emanating from the turbine 10.

The shield 12 is anchored to the foundation 14 by suitable anchor means 50. As thus seen in FIG. 2, the anchor means 50 comprise a bracket 52 which accepts a block 54 attached to each of the first plurality of support members 34 and secure each of the first plurality of support members 34 to the foundation 14. The shield 12 is supported away from the casing by suitable support means 56, such as columns 58. The columns may be directly mounted on the turbine support feet 59 placed adjacent the foundation 14, as is the case with columns 58A and 58B. The columns may be mounted directly on the vertical joint of the casing itself, as shown at 58C in FIGS. 1 and 2. The columns are fabricated of structural beams and serve to both support the shield 12 away from the turbine 10 and also define, with the turbine 10, the predetermined volume 16 in which flying objects emanating from the turbine apparatus are contained by the shield 12. The provision of the interwoven steel cable framework 30 and the attachment thereto of a plurality of plate members 32 maintain this substantially cylindrical shape of the shield 12 as it is disposed about the turbine 10.

The shield 12 is a flexible member which is able to deflect, to absorb, and to dissipate kinetic energy of flying objects emanating from the turbine 10 and contain these objects within the predetermined volume 16 surrounding the turbine apparatus 10. While in this dormant state, the shield 12 exerts a compressive force on the columns 58, a force acting in the direction 60. However, when a malfunction sufficient to cause the turbine 10 to overspeed, such as an immediate loss of associated electrical load, the turbine 10 may possibly fling itself apart. Flying objects created by the destruction of the turbine 10 are usually of a sufficient force to rupture the casing 18 and thus enter the volume 16. The objects impinge upon the shield 12, and the shield deflects to absorb and dissipate the kinetic energies associated with each of the flying objects. When this occurs, the compression force acting in direction 60 upon the support columns 58 changes to a tension force acting in a direction 62 exerted upon the anchor means 50. By deflecting to absorb and dissipate the kinetic energy of the flying objects, the objects are maintained within the predetermined volume 16 around the turbine 10, and damage to any associated elements of the power plant by the high energy flying objects is precluded.

The shield 12 has an opening 64 through which the inlet conduits 28 pass into the inlet 26 of the turbine 10. To also provide protection if objects fly through the inlet 26 of the turbine 10, a hood or bonnet 66 is provided having sufficient overlap to completely prevent objects which have pierced the turbine inlet 26 from rupturing any vital associated elements within the power plant. The hood 66 is fabricated of interwoven steel cables, similar to the fabrication of the remainder of the shield support framework 30 and has a plurality of plate members 32 attached to the radially inward side 42, the attachment being made by clamping means similar to those described in connection with FIGS. 3 and 4. The hood 66 is supported on the shield 12 by a bearing plate 68 fastened to a clamp plate 70, as shown in FIG. 2. The bearing plates 68 support the full load of the hood 66 while fastened to the clamp plate 70. It is to be understood, however, that any suitable means for supporting the hood 66 away from the remainder of the shield 12 as well as to provide overlapping protection for that portion of the shield 12 through which the inlet conduits 28 pass is within the contemplation of this invention.

In order to permit free access to the turbine control components which are usually disposed axially adjacent to the ends of the turbine 10, the shield 12 extends to within only a predetermined axial distance 72 from each end of the turbine 10. Thus, as seen in FIG. 1, the shield 12 axially extends a distance such that the end of the shield 12 and the tip of the last blade root 74 define a predetermined angle 76 with the vertical. The angle 76 is approximately 25°.

It is evidenced from the foregoing that provision of a flexible shield to surround the turbine apparatus taught by this invention overcomes all of the disadvantages of the prior art shielding schemes. The turbine shield taught by this invention is a relatively lightweight, easy-to-fabricate and easy-to-support member. It is able to be supported by the turbine foundation in a more economical manner, and is easily dismantled to permit necessary repairs to the turbine 10. Access to the turbine 10 is provided by the open ends of the shield and by the volume which surrounds the turbine on all sides thereof. The shield is flexible and is able to deflect to dissipate and absorb any kinetic energies associated with flying objects emanating from the turbine, and to contain these flying objects within the predetermined volume surrounding the turbine apparatus, thus preventing damage to associated turbines or steam power plant equipment by the high energy flying objects.

We claim as our invention:

1. A shield for restraining flying objects having kinetic energies associated therewith, said shield enclosing a predetermined volume around a device having movable elements therein, said shield comprising:

a support framework disposed about said device, and, a plate member attached to said framework, said support framework comprising:

a first support member circumferentially dispossed about said device, and, a second support member longitudinally disposed about said device, said second support member being substantially transverse to said first support member, said second support member being connected to said first support member, said first and said second support members defining at least one opening therebetween, said plate member being disposed so as to cover said opening between said first and said second support members, said shield being flexible to deflect when said flying objects impinge thereinto, said deflection of said shield dissipating said kinetic energies of said flying objects and containing said flying objects within said predetermined volume.

2. The shield of claim 1, further comprising anchor means for holding said shield in a predetermined position relative to said device.

3. The shield of claim 2, further comprising, support means for supporting said shield a predetermined distance away from said device, said support means being subjected to a compressive force by said shield when said support means is supporting said shield said predetermined distance from said device, said anchor means being subjected to a tension force when said shield deflects to dissipate said kinetic energies of said flying objects and to contain the flying objects within said volume.

4. A shield for restraining flying objects having kinetic energies associated therewith, said shield enclosing a predetermined volume around a device having rotatable elements therein, said device being mounted on a foundation, said shield comprising, a first plurality of support members circumferentially disposed about said device, a second plurality of support members longitudinally disposed about said device, said second plurality of said support members being substantially transverse to said first plurality of support members, said first and said second pluralities of support members defining a mesh framework having a plurality of openings therein, a plurality of plate members attached to said mesh framework, each of said plurality of plate members being disposed to cover one of said plurality of openings in said mesh framework, said shield being flexible to deflect when said flying objects impinge thereinto, said deflection of said shield dissipating and absorbing said kinetic energies of said flying objects and containing said flying objects within said volume.

5. The shield of claim 4 further comprising, anchor means for holding said shield in a predetermined position relative to said device, said anchor means being attached to said first plurality of said support members and being embedded in said foundation.

6. The shield of claim 5 further comprising, support means for supporting said shield a predetermined distance away from said device, said support means being subjected to a compressive force by said shield when said support means is supporting said shield in a predetermined distance away from said device, said anchor means being subjected to a tension force when said shield deflects to dissipate and absorb said kinetic energies of said flying objects and to contain said flying objects within said volume.

7. The shield of claim 4 wherein said second plurality of longitudinally disposed support members are interlaced with said first plurality of circumferentially disposed support members so that at each point of intersection between said first and said second pluralities of support members one of said second plurality of longitudinally disposed support members is disposed on the radially inward side and the radially outward side of one of said circumferentially disposed first plurality of support members.

8. The shield of claim 7 wherein one of said plurality of plate members is disposed on the radially inward side of said mesh framework, each of said plurality of plate members completely covering one of said plurality of openings in said mesh framework.

9. The shield of claim 8 wherein an access aperture is disposed within said shield, and wherein said shield further comprises a hood member disposed so as to extend over and completely overlap said access aperture, said hood member being supported a predetermined distance away from said shield.

10. The shield of claim 4 wherein said device is substantially cylindrical in shape and has a first and a second end and, wherein said shield extends a predetermined longitudinal distance past said first and said second ends of said device.

11. A turbine mounted on a foundation, said turbine comprising:

an outer casing having a rotor member assembly supported therein, said rotor having an annular array of rotating blades mounted thereon, said rotating blades disposed adjacent to an annular array of stationary blades mounted within said casing, said casing having an inlet opening therein for the introduction to elastic fluid thereinto, and, flexible shield means for restraining flying objects having kinetic energies associated therewith, said flexible shield means enclosing a predetermined volume around said casing, said flexible shield means comprising a support framework disposed about said device, said support framework comprising a first support member circumferentially disposed about said turbine, and, a second support member longitudinally disposed about said turbine, said second support member being substantially transverse to said first support member, said second support member being connected to said first support member, said first and said second support members defining at least one opening therebetween, a plate member attached to said framework, said plate member being disposed so as to cover said opening between said first and said second support members, anchor means for holding said flexible shield means in a predetermined position relative to said turbine, and, support means for supporting said flexible shield means a predetermined distance away from said turbine, said shield means deflecting when said flying objects impinge thereinto, said deflection of said shield dissipating said kinetic energies of said flying objects and containing said flying objects within said predetermined volume.

12. The turbine of claim 11 wherein said support means is subjected to a compressive force by shield when said support means is supporting said shield said predetermined distance from said device, said anchor means is subjected to a tension force when said shield deflects to dissipate said kinetic energy of said flying objects and to contain said flying objects within said volume around said turbine.

13. The turbine of claim 12 wherein said support framework comprises a first plurality of support members circumferentially disposed about said turbine, a second plurality of support members longitudinally disposed about said turbine, said second plurality of support members being substantially transverse to said first plurality of said support members, said first and said second plurality of said support members defining a mesh framework having a plurality of openings therein, a plurality of plate members attached to said mesh framework, each of said plurality of plate members being disposed to cover one of said pluralities of openings in said mesh framework, said shield means being flexible to deflect when said flying objects impinge thereinto, said deflection of said shield dissipating and absorbing said kinetic energy of said flying objects and containing the flying objects within said volume.

14. The turbine of claim 13 wherein said second plurality of longitudinally disposed support members are interlaced with said first plurality of circumferentially disposed support members so that each point of intersection between said first and said second pluralities of support members one of said second plurality of longitudinally disposed support members is disposed on the radially inward and the radially outward side of said circumferentially disposed first plurality of support members.

15. The turbine of claim 14 wherein one of said plurality of said plate members is disposed on the radially inward side of said mesh framework, each of said plurality of plate members covering one of said plurality of openings in said mesh framework.

16. The turbine of claim 15 wherein said flexible shield means has an access aperture disposed within said shield means, and further comprising a hood member disposed so as to extend over and completely overlap said access aperture, said hood member being supported a predetermined distance away from said flexible shield means.

* * * * *